United States Patent [19]

Johnson

[11] 4,183,310

[45] Jan. 15, 1980

[54] FEED AND LOOP TAKER MODULE FOR A SEWING MACHINE

[75] Inventor: Ralph E. Johnson, Convent Station, N.J.

[73] Assignee: The Singer Company, New York, N.Y.

[21] Appl. No.: 971,961

[22] Filed: Dec. 21, 1978

[51] Int. Cl.[2] ..... D05B 57/14; D05B 27/02

[52] U.S. Cl. ..... 112/184; 112/258; 112/323

[58] Field of Search ..... 112/184, 181, 202, 323, 112/324, 258

[56] References Cited

U.S. PATENT DOCUMENTS

| | | | |
|---|---|---|---|
| 2,725,023 | 11/1955 | Ayres | 112/323 X |
| 3,018,747 | 1/1962 | Moro | 112/258 |
| 3,019,750 | 2/1962 | Bono | 112/323 |
| 3,476,067 | 11/1969 | Johnson | 112/258 X |
| 4,019,450 | 4/1977 | Adams | 112/323 |

*Primary Examiner*—H. Hampton Hunter

*Attorney, Agent, or Firm*—William V. Ebs; Robert E. Smith; Edward L. Bell

[57] ABSTRACT

Work feeding mechanism and a rotatable loop taker are provided for a sewing machine in a module wherein a rock shaft connects with a feed bar through a flat spring enabling a feed dog on the feed bar to be moved by camming means in a direction perpendicular to the work feeding direction as the feed dog is moved in the work feeding direction by the action of the rock shaft. The camming means which is disposed under the feed bar is located in line with the feed dog to minimize inertia effects and guiding means associated with the feed bar maintain the feed dog level as the feed dog is moved in the work feeding direction and perpendicular to it.

15 Claims, 16 Drawing Figures

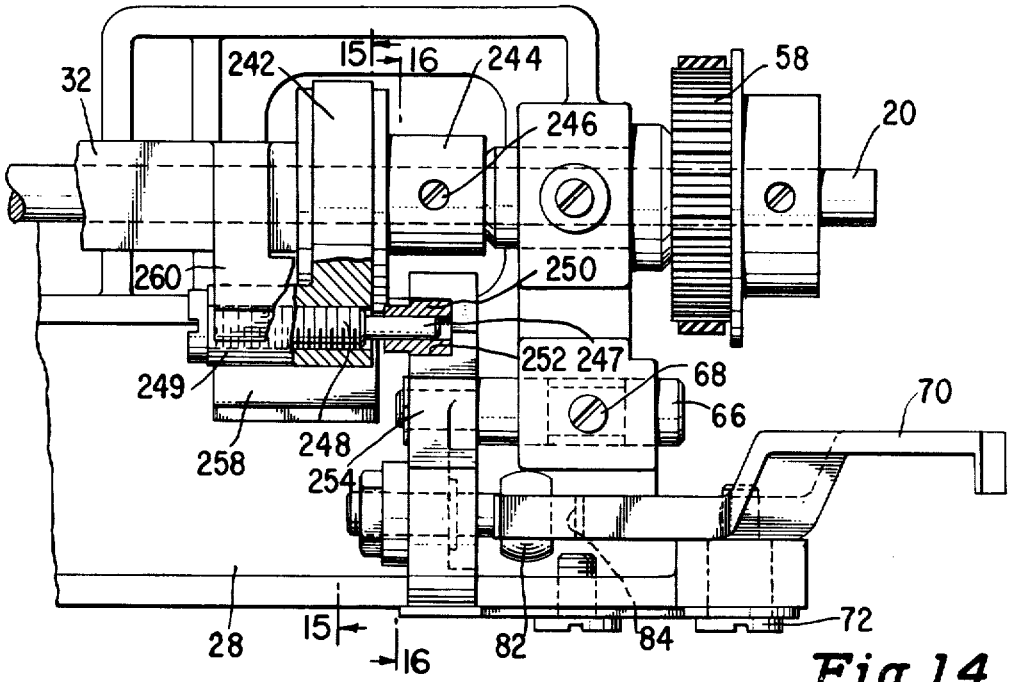
Fig. 14
Fig. 15
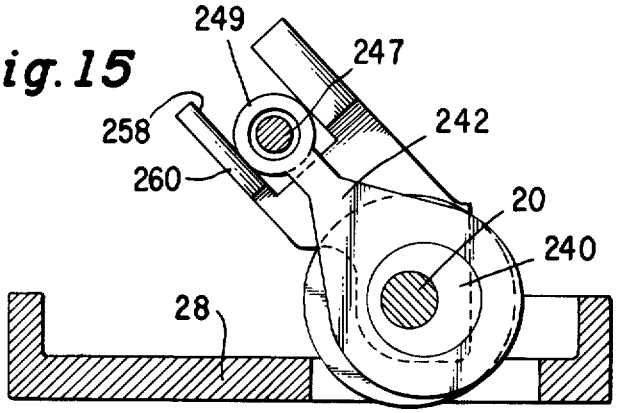
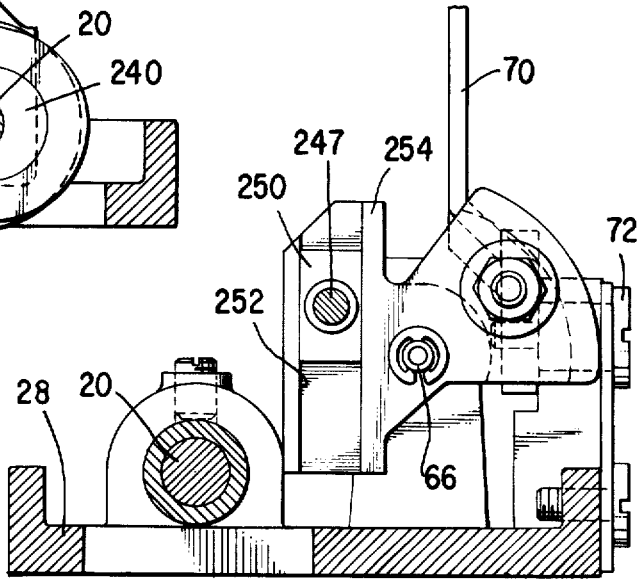
Fig. 16

FEED AND LOOP TAKER MODULE FOR A SEWING MACHINE

BACKGROUND OF THE INVENTION

1. Field of the Invention

The invention relates to work feeding mechanisms for sewing machines and in particular to work feeding mechanisms in modular form.

2. Description of the Prior Art

Difficulties are encountered with the sewing machine feeding mechanisms known in the prior art due to the relative movement of parts resulting in undesireable variations in the motion of the feed dog, and also because of the large inertia forces encountered during their operation. Further, assembly of these feeding mechanisms and related parts in a machine casing has been a time consuming and a costly operation.

It is a prime object of this invention to provide an improved feeding mechanism which does not have the disadvantages of the prior art mechanism, and is producible in modular form in combination with a vertically oriented loop taker.

SUMMARY OF THE INVENTION

In accordance with the invention, a feed bar is connected by a flat spring to a rock shaft which imparts motion in a work feeding direction to a feed dog affixed to the feed bar. The spring permits motion of the feed bar and feed dog in a direction perpendicular to the work feeding direction, and camming means are provided under the feed bar in alignment with the feed dog to impart such perpendicular motion to the feed bar and feed dog. Guiding means impose restraints on movement of the feed bar in a manner effective to maintain the feed dog level. The feed mechanism and a vertically oriented loop taker form a compact modular subassembly which is easily secured within the casing of a sewing machine.

DESCRIPTION OF THE DRAWINGS

FIG. 14 is a top plan view showing another modified form of feed regulator;

FIG. 15, is a sectional view taken on the plane of the line 15—15 of FIG. 14;

FIG. 16 is a sectional view taken on the plane of the line 16—16 of FIG. 14.

DETAILED DESCRIPTION OF THE INVENTION

Figure 1:
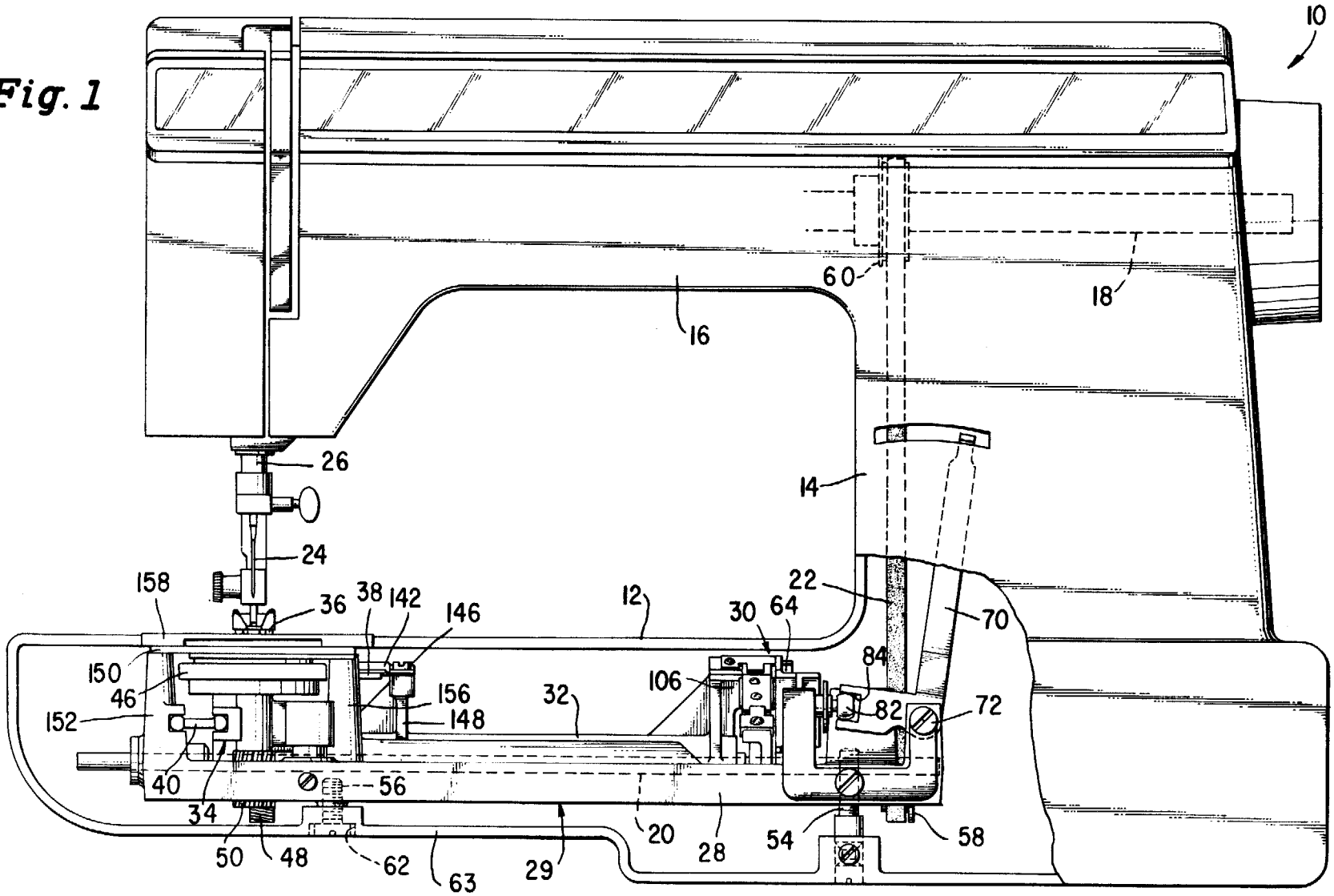
FIG. 1 is a front elevational view of a sewing machine shown with a portion of the casing broken away to reveal a feed and loop taker module according to the invention.

Referring to FIGS. 1 through 9 of the drawings, reference character 10 designates a sewing machine which is shown as including a bed 12, a standard 14 rising from the bed and a bracket arm 16 overhanging the bed. The driving mechanism of the sewing machine includes an arm shaft 18 and a bed shaft 20 interconnected in timed relation by a timing belt 22. A needle 24 is carried for endwise reciprocation by a needle bar 26 and conventional connections (not shown) are to be understood as existing between the arm shaft 18 and needle bar 26 for imparting reciprocating movements to the needle.

The bed shaft 20 is supported in the frame 28 of a work feed and loop taker module 29 according to the invention which module includes in addition to the bed shaft 20, feed regulating mechanism 30, a rock shaft 32, a feed bar 34 and attached feed dog 36, a driving connection between the rock shaft and feed bar in the form of a flat spring 38, a transversely extending feed bar guiding link 40, a transversely extending feed bar guiding member and feed bar slot 42 and 44 respectively, a loop taker 46 rotatable about a vertical axis, loop taker driving gears 48 and 50, and a pin carrying sleeve 52. Frame 28 is secured to the bottom of the machine by screws 54 and 56. By turning the screw 54 the module 29 can be raised and lowered to loosen or tighten respectively timing belt 22 which extends over a pulley 58 secured on bed shaft 20 and a pulley 60 affixed to arm shaft 18. Screw 56 is movable within an enlarged hole 62 in machine housing 63 and permits the frame to be pivoted about the other screw 54 to thereby effect adjustments in the position of the loop taker with respect to the needle 24 after which the screw may be tightened against the housing.

Feed regulating mechanism 30 includes an angularly adjustable member 64 which is pivoted on a shaft 66 affixed in frame 28 by a screw 68, and means for positioning the adjustable member 64. The positioning means is shown as including a manually positionable lever 70 which is pivoted on a screw 72 affixed in frame 28, and including a stud 76 that is attached at a threaded end 78 by nut 80 to adjustable member 64 and is connected with lever 70 through a spherical bearing element 82 located in a socket 84 of the lever. Adjustable member 64 is formed with a channel 86, and a member 88 is disposed for sliding movements within the channel. Member 88 is pivoted on a stud 90 which is attached to an arm 92 of a crank 94. The crank is operable by eccentrics 96 and 97 rotatable with bed shaft 20. Such crank 94 includes a second arm 98 the end of which is attached to one end of a flat spring 102 by a screw 104 that extends through a bracket 105 into the arm. The other end of spring 102 is secured to an arm 106 integral with rock shaft 32 by a plate 108, screws 110, 112 and nuts 113 in engagement with the screws. Spring 102 is stiffened adjacent arm 98 by the bracket 105 and is stiffened adjacent arm 106 by plate 108. The middle portion of the spring 102 is stiffened by brackets 114 and 115 which are secured to the spring by screws 116 and 118 that extend through the brackets and spring and into block 120.

As the bed shaft 20 is rotated, eccentrics 96 and 97 impart reciprocating movements to crank 94, and the crank acting through arm 98 and spring 102 reciprocates arm 106 and rock shaft 32. As the rock shaft 32 is driven through spring 102 relative movement of crank 94 and rock shaft 32 in a direction perpendicular to the line of action through the spring is accommodated by bending action of the spring which flexes between the stiffened portions where tongues 122 and 123 on brackets 105 and 114 respectively and tongues 124 and 125 on the plate 108 and bracket 114 respectively permit only smooth bends to occur. An operator predetermines the extent and direction (forward or reverse) of the rock shaft movements and resulting movements of feed dog 36 in response to rotation of bed shaft 20 by disposing member 64 in a selected angular position with lever 70.

Spring 102 can't bend laterally and twisting is prevented by the stiffeners. The spring is therefor effective to prevent any longitudinal relative movement of the crank 94 and rock shaft 32. Longitudinal movement of the crank and rock shaft relative to the frame 28 is prevented by the engagement of a fixed pin 138 with the side of a slot 140 in a member 142 secured by screws 144 and 146 to a rock shaft arm 148. The fixed pin 138 is located in a bed plate 150 which mounts on posts 152, 154 and 156 of the frame 28 and supports a throat plate 158.

Flat spring 38 is secured at one end under member 142 to rock shaft arm 148 by the screws 144 and 146, and is secured at the other end to the top of feed bar 34 by screws 162 and 164. The feed dog 36 is secured to the feed bar by screws 166 and 168, and is moved in forward and reverse work feeding directions by the rock shaft 32 acting through spring 38 and feed bar 34 while the rock shaft is reciprocated as hereinbefore explained in response to the rotation of bed shaft 20. The feed dog is also moved perpendicular to the work feed directions by camming means including the collar 52 force fitted on an internal eccentric hub 169 of needle loop taker drive gear 48 which is affixed to shaft 20. Such camming means further includes a member 170 having a pin 171 thereon pivotally mounted in a hole 172 in collar 52, and having another pin 174 thereon offset from the 171 and normally affixed in holes 175 and 176 in a depending portion 173 of feed bar 34 with a threaded tie bolt 177 and nut 178. The tie bolt and nut fix the pin 174 in member 173 when the nut is tightened against end surfaces of the member, and when the nut is loosened permit adjustments in the rotational position of the pin 174 in member 173 whereby adjustments may be made in the height to which the feed dog 36 is caused to rise above the throat plate 158.

Link 40, which extends transversely in frame 28, has an end pivotably mounted in an elongated slot 180 in the shank 179 of feed bar 34, and has the other end pivotable in slots 182 and 184 in frame 28, prevents end-to-end tilting movements of the feed dog, that is movements about an axis perpendicular to the work feeding direction. Such link 40 is held back in slots 182 and 184 by a spring 186 which is anchored at one end in the bed plate 150 and extends about a pin 188 to engage the link at the other end in a hole 189. Link 40 is restrained from moving transversely by pin end 190 extending into a slot 192 formed in the link. Transversely extending member 42 which is affixed in the bottom of frame 28 extends into feed bar slot 44 to prevent side-to-side tilting movements of the feed dog, that is movements about an axis extending in the work feeding direction.

Figure 2:
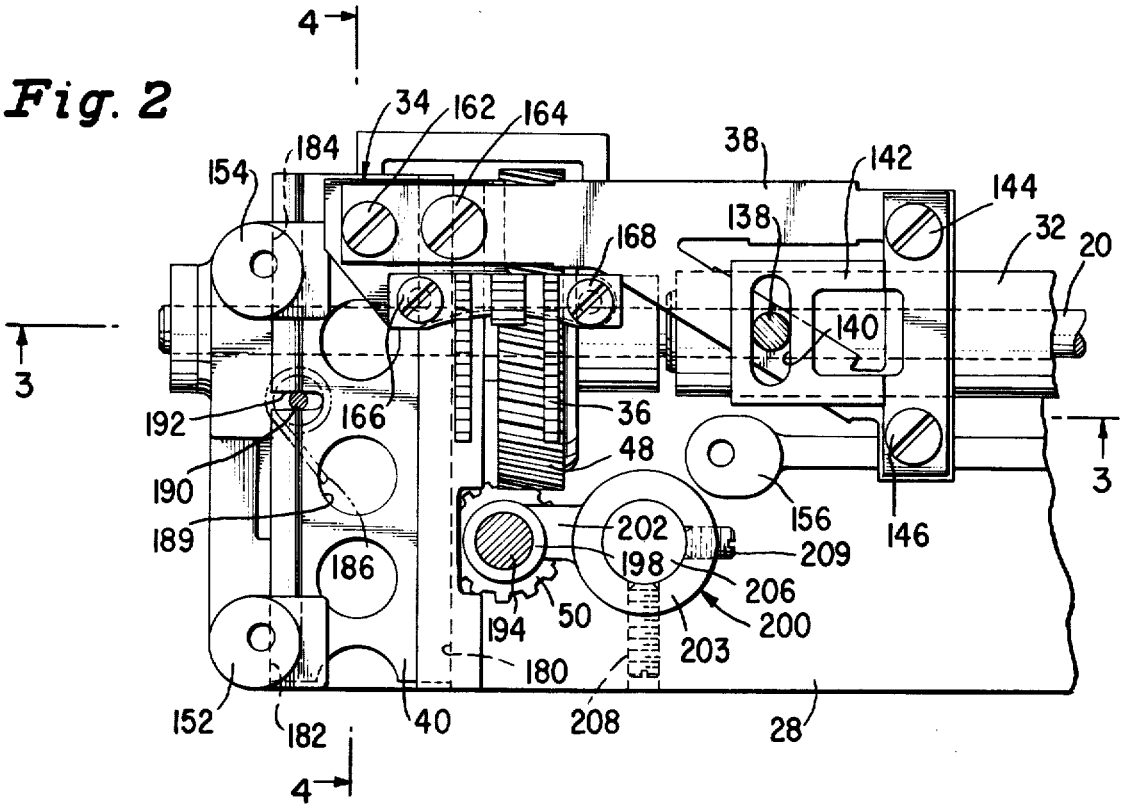
FIG. 2 is a top plan view showing a head end portion of the module from which the bed plate has been removed.
Figure 3:
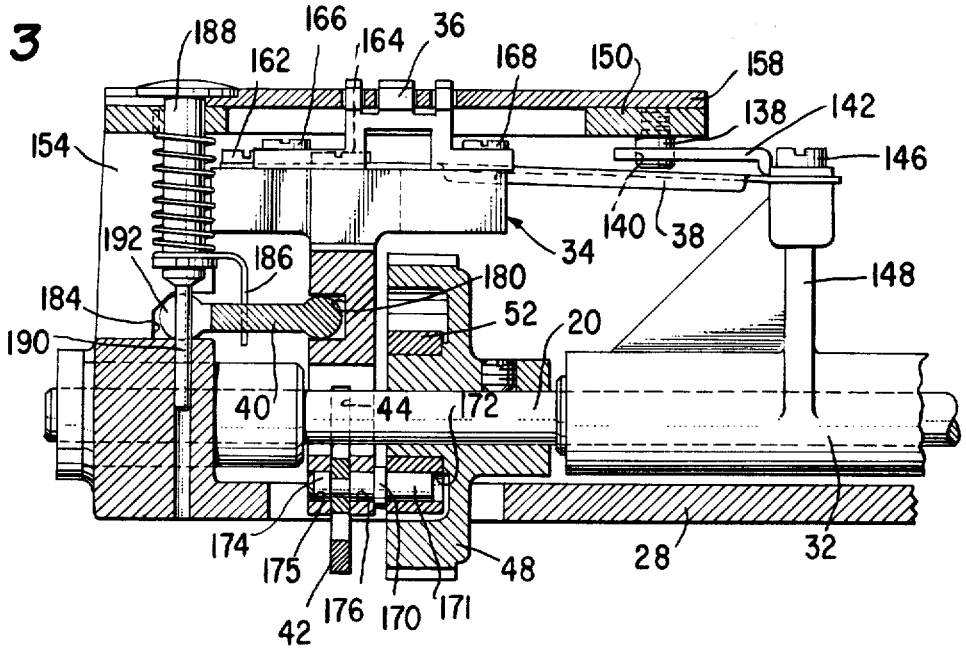
FIG. 3 is an elevational sectional view of the head end portion of the module taken approximately along the line 3—3 of FIG. 2.
Figure 4:
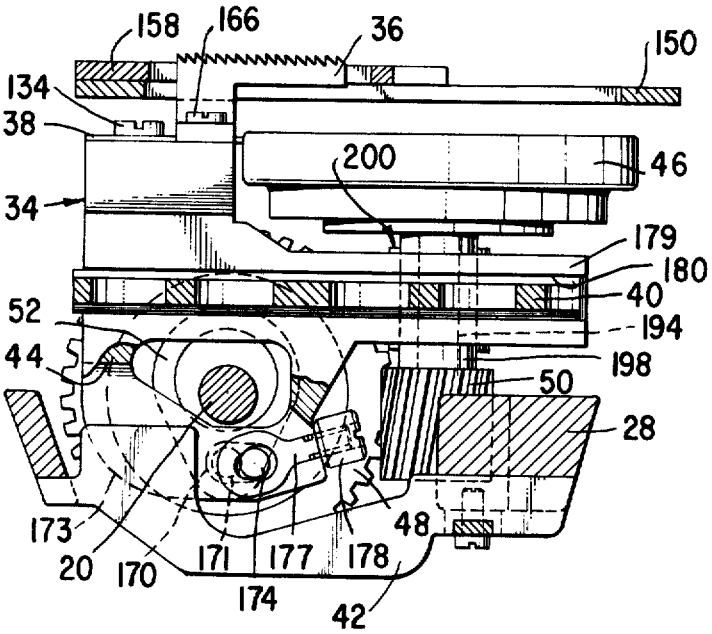
FIG. 4 is a sectional view of the head end portion of the module taken on the plane of the line 4—4 of FIG. 2.
Figure 5:
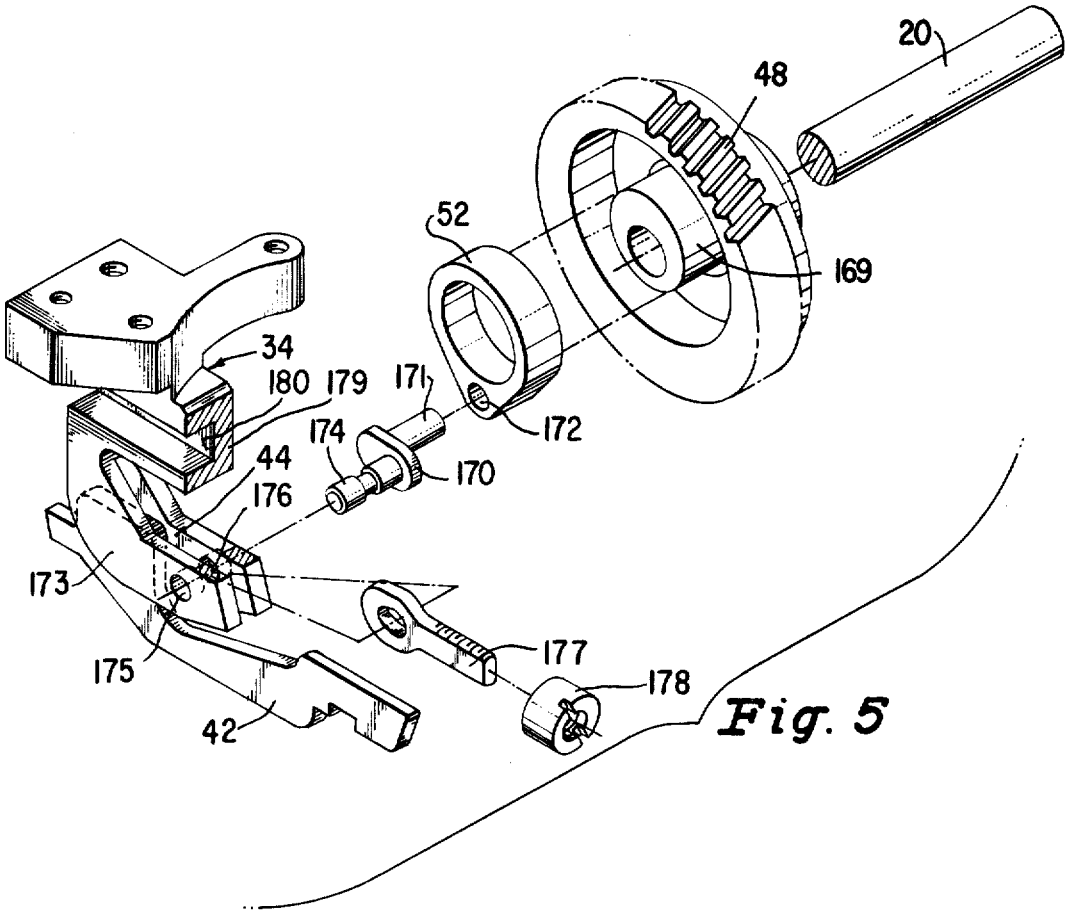
FIG. 5 is an exploded perspective view showing portions of the mechanism illustrated in FIGS. 2, 3 and 4.
Figure 6:
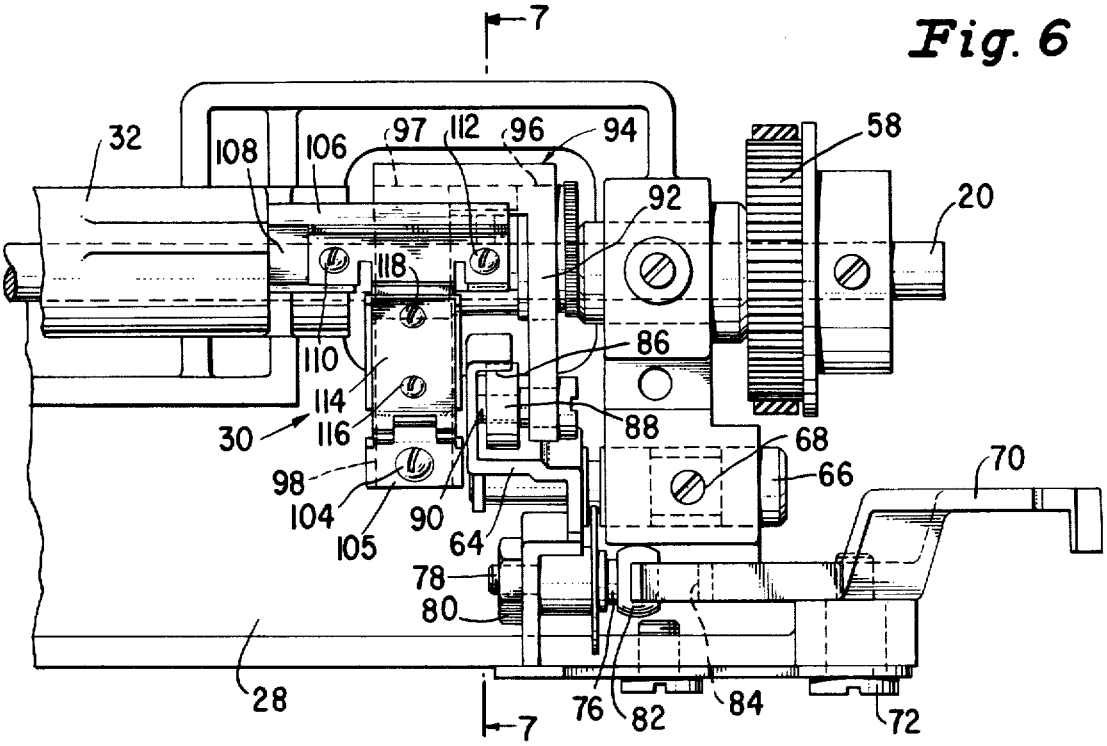
FIG. 6 is a top plane view showing the feed regulator of the module.
Figure 7:
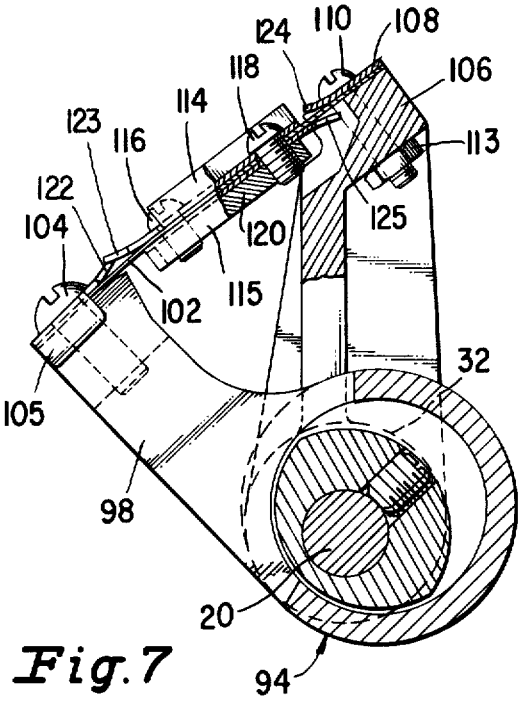
FIG. 7 is a sectional view on the plane of the line 7—7 of FIG. 6.
Figure 8:
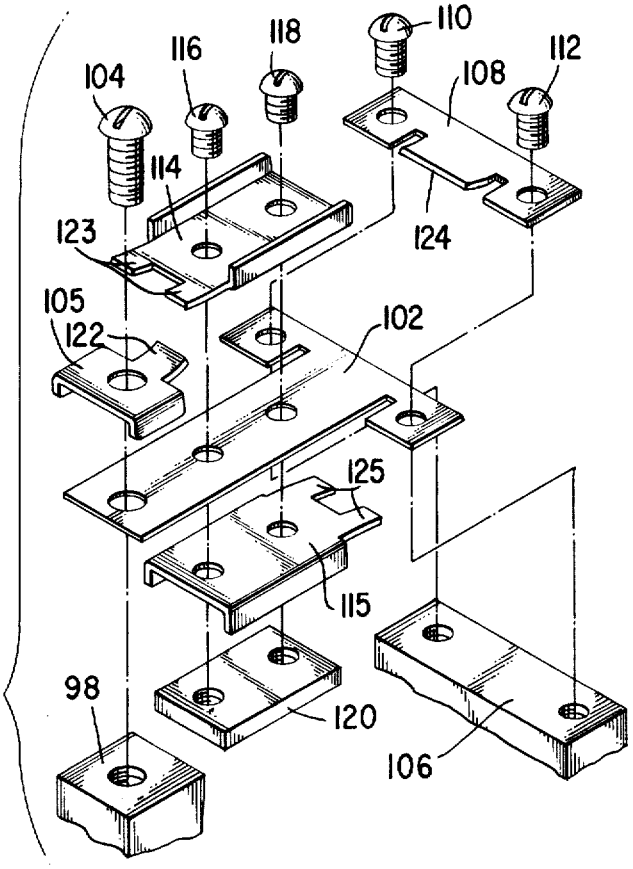
FIG. 8 is an exploaded perspective view showing a portion of the mechanism illustrated in FIG. 7.
Figure 9:
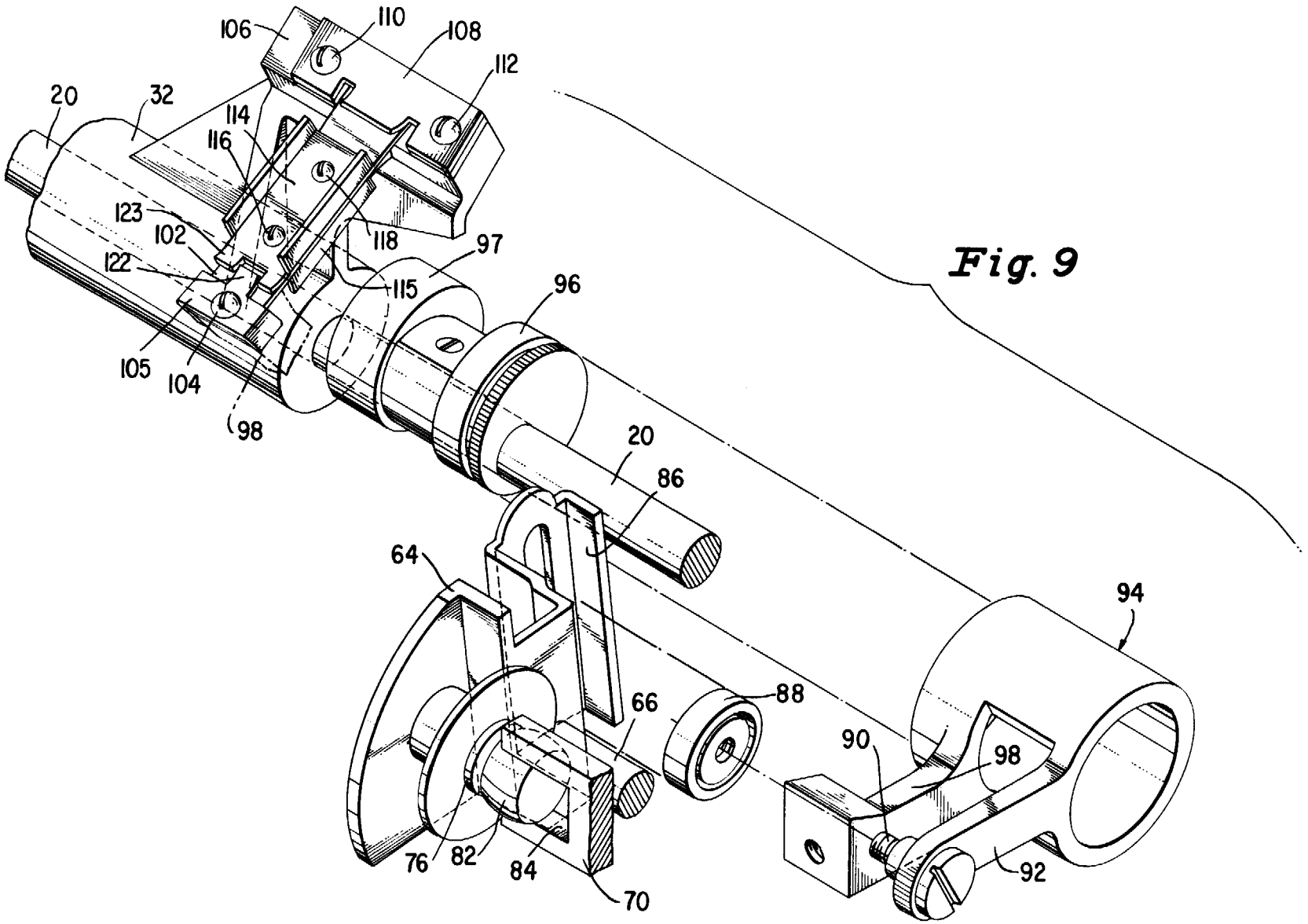
FIG. 9 is a partially exploded perspective view showing the feed regulator.

Loop taker 46 is affixed to the upper end of a vertical shaft 194 which is rotatably mounted in a bushing 198 on an adjustable member 200. Gear 50 secured to a lower end portion of the shaft 194 meshes with gear 48 on bed shaft 20, and as the shaft 20 turns shaft 194 and the loop taker are driven through the gears 48 and 50. As shown in FIG. 2, bushing 198 is at one end of an arm 202 on member 200. The other end of the arm is integral with a collar 203 which is mounted on a stub shaft 206 affixed in the frame by screw 208. The collar 203 is rotationally adjustable on shaft 206 and is provided with suitable means such as the set screw 209 for securing the collar in a selected position providing for proper meshing engagement of the gears 48 and 50.

Figure 10:
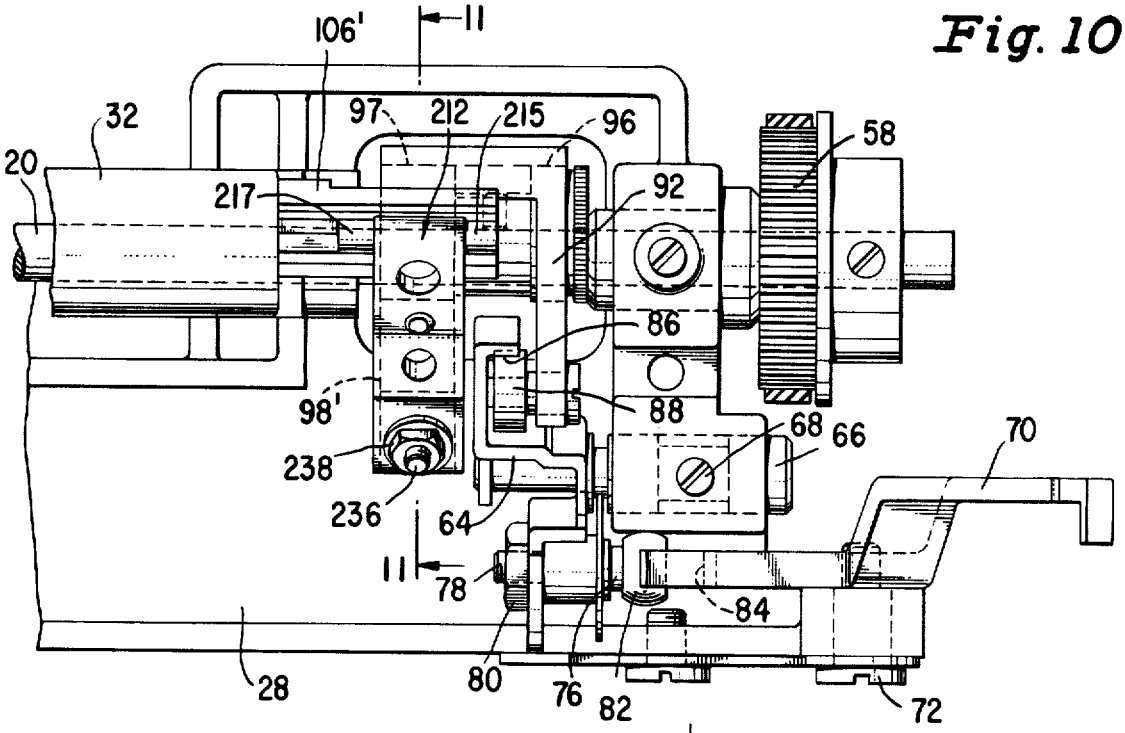
FIG. 10 is a top plan view showing a modified form of feed regulator.
Figure 11:
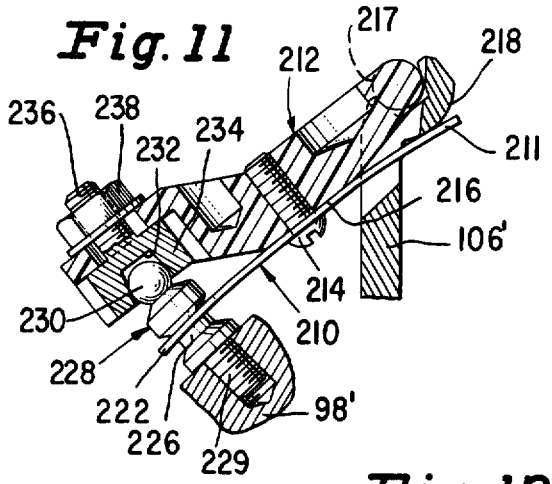
FIG. 11 is a sectional view taken on the plane of the line 11—11 of FIG. 10.
Figure 12:
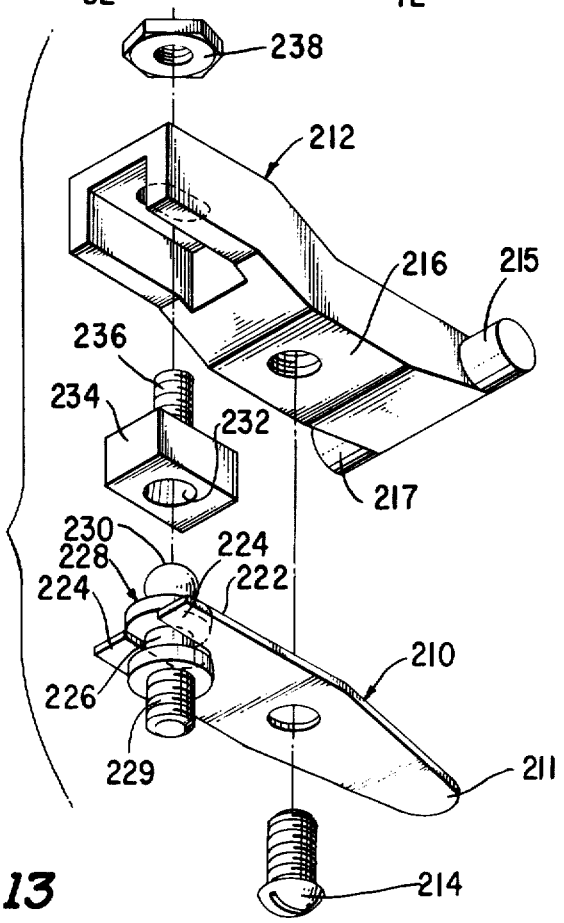
FIG. 12 is an enlarged exploaded perspective view of the mechanism illustrated in FIG. 11.

The driving connection at the feed regulating end of the feed and loop taker module between arm 98 of crank 94 which is driven by the eccentrics 96 and 97 on bed shaft 20, and the arm 106 on the rock shaft 32 has been described as a stiffened spring 102 affixed to said arms at opposite ends. Such driving connection may, however, be modified as shown in FIGS. 10, 11 and 12 wherein reference characters 98' and 106' designate arms corresponding to the arms 98 and 106 respectively but altered for the mounting thereon in a unique manner of a flat spring 210 and plastic link 212. As shown the spring 210 has an intermediate portion secured by a screw 214 against a bottom portion 216 of the link 212. One end 211 of the spring extends beyond the contacted bottom portion of the link to bear against the underside of a bearing 218 provided on arm 106' for pins 215 and 217 which are integral parts of the link. The opposite end 222 of the spring extends beyond the contacted bottom portion of the link to a fork 224 which embraces the post 226 of a fitting 228 that is secured at one end 229 in arm 98'. The opposite end of fitting 228 includes a ball 230 which is engaged in the socket 232 of a block 234 secured by bolt 236 and nut 238 to plastic link 212 as shown. When arm 98' is reciprocated by the action of the eccentric in response to the rotation of the bed shaft 20, plastic link 212 is caused to drive the arm 106'. While the arm 106' is driven by link 212 spring 210 maintains the pins 215 and 217 in the bearing 218 and the socket 232 against ball 230, and lateral movement of the link 212 is prevented by the engagement of side edges 239 of the link with the bearing. The spring bends to accommodate relative movement of the arms 98' and 106' but only slightly because of the freedom of movement permitted at opposite ends. The possibility of failure of the spring 210 on account of metal fatigue is thereby minimized and the spring in combination with the link 212 serve as a very durable driving connection between the arms 98' and 106'.

Figure 13:
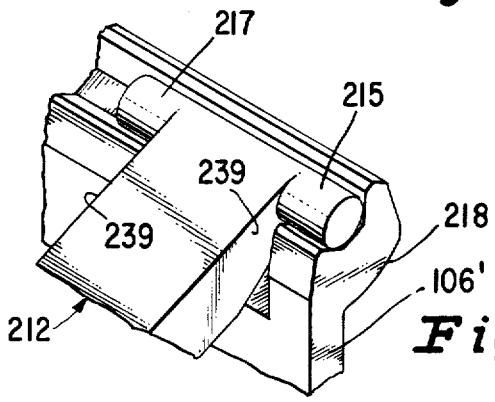
FIG. 13 is a fragmentary perspective view showing a portion of the mechanism of FIG. 11.

Still another form of driving connection between the bed and rock shafts is shown in FIGS. 13, 14 and 15 which depict a construction not requiring the use of a spring or other flexible member as a driving element. In accordance with such construction the bed shaft 20 is provided with an eccentric 240 to drive an arm 242, the eccentric being integral with a hub 244 which is secured to shaft 20 by a screw 246. A pin 247 on a screw 248 affixed in a collar 249 on arm 242 pivotally supports a slide block 250 which rides in a slot 252 in an angularly adjustable member 254. Collar 249 rides in a slot 258 in an arm 260 that is integral with rock shaft 32. As shaft 20 rotates eccentric 240 drives arm 242 and the sleeve 252 acts on arm 260 to impart reciprocatory motion to rock shaft 32. The extent and direction of the rock shaft movements in response to rotation of shaft 20 depends upon the angular position of member 254 as selected with lever 70 which is pivoted on screw 72 and connects with member 254 through a spherical bearing element 82 on member 254.

It is to be understood that the present disclosure relates to preferred embodiments of the invention which are for purposes of illustration only, and that various changes and modifications may be made therein without departing from the spirit and scope of the invention as defined in the appended claims.

I claim:

1. In a sewing machine, the combination comprising, a bed shaft; a feed dog; a feed bar to move the feed dog; means for actuating the feed bar to cause the feed dog to move in a work feeding direction including a rock shaft, means operably connected with the bed shaft for actuating the rock shaft in response to rotation of the bed shaft, and a flat spring connection between the rock shaft and feed bar permitting the feed bar and feed dog to move relative to the rock shaft in a direction which is perpendicular to the work feeding direction; means for moving the feed dog in said perpendicular direction including camming means operably connected with the feed bar and responsive to rotation of the bed shaft; a frame wherein the bed shaft, rock shaft, feed bar actuating means and means for moving the feed dog in the said perpendicular direction are supported; and guide means associated with the frame and feed bar for maintaining the feed dog level while permitting movement in the work feeding direction and relative to the rock shaft in said direction perpendicular to the work feeding direction.

2. The combination of claim 1 wherein the guide means associated with the frame and feed bar includes a slot, and a member slidable therein relatively movable in the slot in the work feeding direction and perpendicular thereto.

3. The combination of claim 1 wherein the guide means associated with the frame and feed bar includes a link with parallel opposite ends one of which is mounted in said frame for pivotal motion about an axis extending in the work feeding direction and the other end of which has the feed bar mounted thereon for movement in the work feeding direction and perpendicular thereto.

4. The combination of claim 3 wherein the guide means also includes a slot and member slidable therein relatively movable in the work feeding direction and perpendicular thereto.

5. The combination of claim 1 wherein the camming means includes an eccentric under a portion of the feed bar and means operably connecting the eccentric with the feed bar.

6. The combination of claim 1 including a vertical axis loop taker, means for driving the loop taker including a gear on the bed shaft located under a portion of the feed bar, said camming means including an eccentric located in a common vertical plane with the gear and rotatable with the gear, the camming means also including means operably connecting the eccentric with the feed bar.

7. The combination of claim 6 wherein the eccentric is a hub on said gear and the means operably connecting the eccentric with the feed bar includes a sleeve on the eccentric and a member pin-connected to the sleeve and feed bar.

8. The combination of claim 7 wherein one end of said member is a pin affixed in the feed bar and the other end is a pin pivotably connected to the sleeve.

9. The combination of claim 8 including means permitting rotational adjustment of the said one end of the member in the feed bar, and the said one end being offset from the other end of the member.

10. The combination of claim 1 wherein the means operably connected with the bed shaft for moving the rock shaft includes a feed regulating member pivoted in the frame and angularly adjustable into a selected position thereon, the feed regulating member including a guideway; a crank actuable by the eccentric, such crank including an arm with a member thereon movable in the guideway; and means operably connecting said crank with the rock shaft.

11. The combination of claim 10 wherein the means operably connecting the crank with the rock shaft includes another arm on said crank, an arm on the rock shaft and a flat spring connecting said another arm of the crank with the arm on the rock shaft.

12. The combination of claim 11 including stiffening means fastened to said flat spring.

13. The combination of claim 10 wherein the means operably connecting the crank with the rock shaft includes another arm on the crank, an arm on the rock shaft, a force transmitting link between such arms, and a link attached flat spring which is supported by the arms and maintains an assembled relationship between the arms and link.

14. The combination of claim 13 wherein said another arm and rock shaft arm pivotally interconnect with the force transmitting link.

15. The combination of claim 10 wherein the means operably connecting the crank with the rock shaft includes an arm on the rock shaft with a guideway thereon, and means slidable along the guideway on the crank arm and the guideway on the rock shaft arm for transmitting motion between the crank and rock shaft.

* * * * *